United States Patent [19]

Gogniat et al.

[11] 4,105,986

[45] Aug. 8, 1978

[54] DISTRIBUTION TRANSFORMER SECONDARY CIRCUIT INTERRUPTER HAVING AN IMPROVED BIMETAL

[75] Inventors: Theodore Gogniat, Monroeville, Pa.; John F. Cotton, Athens, Ga.

[73] Assignee: Westinghouse Electric Corp., Pittsburgh, Pa.

[21] Appl. No.: 744,860

[22] Filed: Nov. 24, 1976

Related U.S. Application Data

[63] Continuation of Ser. No. 582,562, May 30, 1975, abandoned.

[51] Int. Cl.[2] ..... H01H 37/52; H01H 71/16

[52] U.S. Cl. ..... 337/3; 337/111; 337/379

[58] Field of Search ..... 337/3, 111, 379

[56] References Cited

U.S. PATENT DOCUMENTS 2,122,693 7/1938 Maseng ..... 337/111

*Primary Examiner*—Harold Broome

*Attorney, Agent, or Firm*—Robert E. Converse, Jr.

[57] ABSTRACT

A circuit breaker particularly adapted for use in an oil filled distribution transformer includes an improved bimetal trip actuator which exhibits greater deflection for a given degree of power dissipation. The trip actuator includes a planar bimetal element held relatively stationary at one end and free to deflect at the other end in response to overload current conditions through the circuit breaker. The bimetal element is constructed to have a higher power dissipation in proximity to the stationary end than in proximity to the deflecting end.

6 Claims, 7 Drawing Figures

DISTRIBUTION TRANSFORMER SECONDARY CIRCUIT INTERRUPTER HAVING AN IMPROVED BIMETAL

This is a Continuation of application Ser. No. 582,562 filed May 30, 1975 now abandoned.

CROSS REFERENCE TO RELATED APPLICATION

This case is related to copending patent application Ser. No. 496,800 filed Aug, 12, 1974 by John F. Cotton, Jack G. Hanks and Raymond E. Wien.

BACKGROUND OF THE INVENTION

1. Field of the Invention

This invention relates to circuit breakers of the type having a bimetallic thermal trip element and, more particularly, to a circuit breaker for use in distribution transformers to control moderate power distribution on feeder circuits having a bimetallic trip element wherein the power dissipation is concentrated in the base of the bimetal.

2. Description of the Prior Art

The disclosed circuit breaker is particularly adaptable for use with distribution transformers. Transformers used in power distribution systems are generally associated with a protective device which prevents or limits current overload damage to the transformer and its associated apparatus. The completely self-protected transformer includes a circuit breaker on the secondary or low voltage side to protect against damage due to overload currents. The secondary breaker disconnects the transformer from its load if the load current becomes dangerously high.

Commonly used circuit breakers incorporate three basic features: (1) a low overload signal device, (2) an incremental increase adjustment and (3) a tripping device to open the contacts of the circuit breaker upon a predetermined overload. A bimetallic element is disposed in series in the circuit breaker. As the load current increases through the circuit breaker, a low overload point is reached at which the bimetallic element deflects enough to activate a signal light on the outside of the transformer housing. The signal light which is mounted on the transformer provides a visual indication that the secondary circuit breaker is about to trip. That is, the signal light is turned on at a lower overload than that required to trip the circuit breaker, thereby indicating that the load current is approaching trip level. As the load current continues to increase, the bimetallic element deflects further until a second overload point is reached at which the circuit breaker trips open. The circuit breaker tripping operation protects the transformer against severe damage due to the flow of excessive overload current. The bimetallic element is also responsive to the ambient temperature of the surrounding oil allowing a predetermined oil temperature rise to also produce the required deflection to activate the signal light or trip the breaker. It is desirable to minimize the power dissipated in the bimetallic element during operation while still achieving the required deflections. The bimetallic elements utilized in prior art circuit breakers are generally constructed for a linear power dissipation along their lengths.

SUMMARY OF THE INVENTION

An oil filled transformer having a circuit interrupter disosed within the transformer housing which utilizes a bimetallic thermal trip element for opening the circuit interrupter under various conditions of overload, wherein the bimetallic thermal trip element is constructed to concentrate the power dissipation in the base of the bimetal. The circuit interrupter utilizes a movable contact, movable between an open position spaced from a stationary contact and a closed position engaging the stationary contact, to complete a series circuit through the transformer to a low voltage terminal located on the transformer housing. The movable contact is spring-biased toward the open position, spaced from the stationary contact, but when the circuit interrupter is closed the movable contact is held in engagement with the stationary contact by a latching means. A bimetallic actuating means disposed in series in the circuit through the transformer is connected so that when current flow therethrough exceeds an overload trip value, the bimetal actuating means moves the latch to an unlatched position, permitting the circuit interrupter to trip open. The bimetal is also responsive to the temperature of the surrounding oil and will deflect when the oil is heated for any reason. An operating handle for the circuit breaker is located on the outside of the transformer housing and is connected to the operating mechanism on the circuit breaker. The circuit breaker also includes a signal light contact which closes when current through the circuit breaker exceeds a low overload value les than the overload trip value. The signal light contact is connected to a signal light located on the exterior of the transformer housing for providing a visual indication that a low overload condition has been sustained. When the signal light circuit is activated, it will not automatically reset, but can be reset by moving the operating handle away from the off position path the normal on position. That is, with the circuit breaker in the on position, the signal light contact is reset without moving the handle towards the off position, but by moving the operating handle past the on position. This prevents accidental tripping of the circuit breaker when resetting the signal light circuit.

The disclosed transformer secondary circuit breaker utilizes a single toggle and latching mechanism for operating two or three poles. In the disclosed transformer the circuit breaker contacts are located below the bimetallic sensing element and, if for any reason, the transformer develops an oil leak, the bimetal will be first exposed above the oil, causing the circuit breaker to trip while the contacts are still under oil. This sequence of operation prevents contact arcing in the volatile gas space above the reduced oil level.

The movable contact is disposed at the end of an elongated contact arm which is pivotal around an axis to move the contact between a closed position completing an electric circuit through the stationary contact and an open position spaced from the stationary contact. A primary latch means is connected to the elongated contact arm for latching the movable contact in a closed position. A secondary latch means is provided for keeping the primary latch in the latched position. Bimetallic actuating means, responsive to current flow and/or oil temperature, are provided for unlatching the secondary latch when predetermined conditions are exceeded. An overcenter toggle, which is spring biased towards a collapsed position, is connected to the elongated contact arm and is held in the overcenter extended position by the primary latch when the circuit breaker is in the normal closed position. When the secondary latch is unlatched, due to a current overload or excess oil temperature, the primary latch moves to the unlatched position, permitting the spring biased toggle to collapse, opening the circuit interrupter with a snap action.

It is an object of this invention to teach a circuit interrupter for a distribution transformer wherein tripping of the circuit interrupter is controlled by a formed bimetal having a power dissipation concentration in the base of the bimetal.

BRIEF DESCRIPTION OF THE DRAWINGS

For a better understanding of this invention, reference may be had to the preferred embodiments exemplary of this invention shown in the accompanying drawings, in which.

DESCRIPTION OF THE PREFERRED EMBODIMENTS

Figure 1:
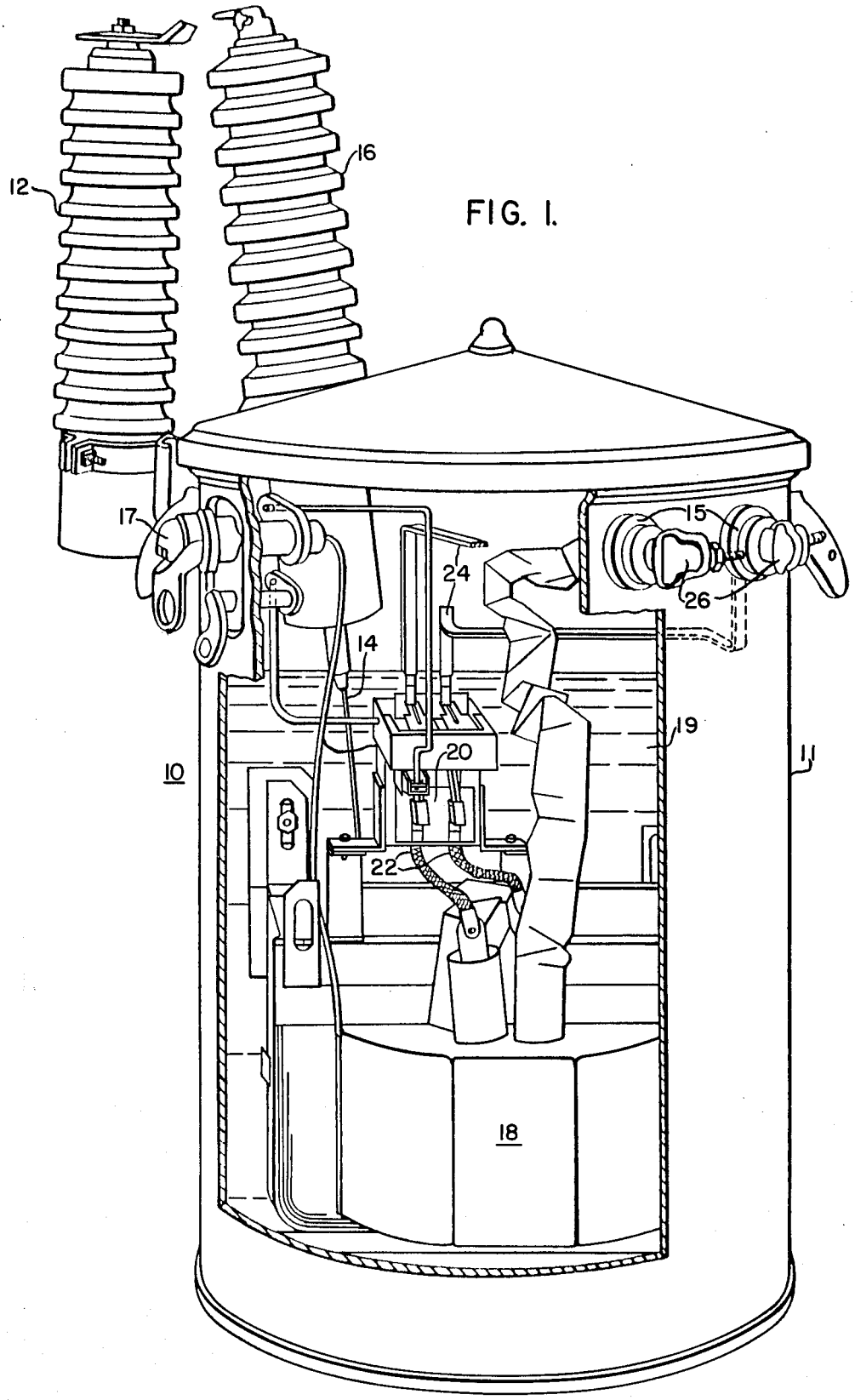
FIG. 1 is a perspective view of an oil filled distribution transformer utilizing the teachings of the present invention.

Referring now to the drawings, and FIG. 1 in particular, there is shown a pole type completely self-protected distribution transformer 10 including a circuit breaker 20 utilizing the teaching of the present invention. The transformer 10 includes an enclosure or tank 11 with a lightning arrestor 12 and a primary high voltage bushing 16 mounted thereon. Secondary bushings, such as the low voltage bushing 15, are attached to the enclosure 11 to which the transformer load is connected. A signal light 17 is mounted on the enclosure 11 and is electrically connected to the circuit breaker 20 to be actuated at a predetermined low overload. The core and coil assembly 18 is secured inside the enclosure 11 with the circuit breaker 20 attached thereto. Required primary winding leads 14 extend from the core and coil assembly 18 to the appropriate high voltage bushings 16. The housing 11 is partially filled with an insulating liquid dielectric 19, such as transformer oil. The circuit breaker 20 and the core and coil assembly 18 are immersed in the insulating oil 19. Secondary connections 22, coming from the core and coil assembly 18, connect to input terminals on circuit breaker 20. Conductors 24 connect the output terminals of circuit breaker 20 to the low voltage bushings 15 mounted to the transformer tank 11. Appropriate loads can then be connected to the low voltage terminals 26 of the distribution transformer 10.

Figure 2:
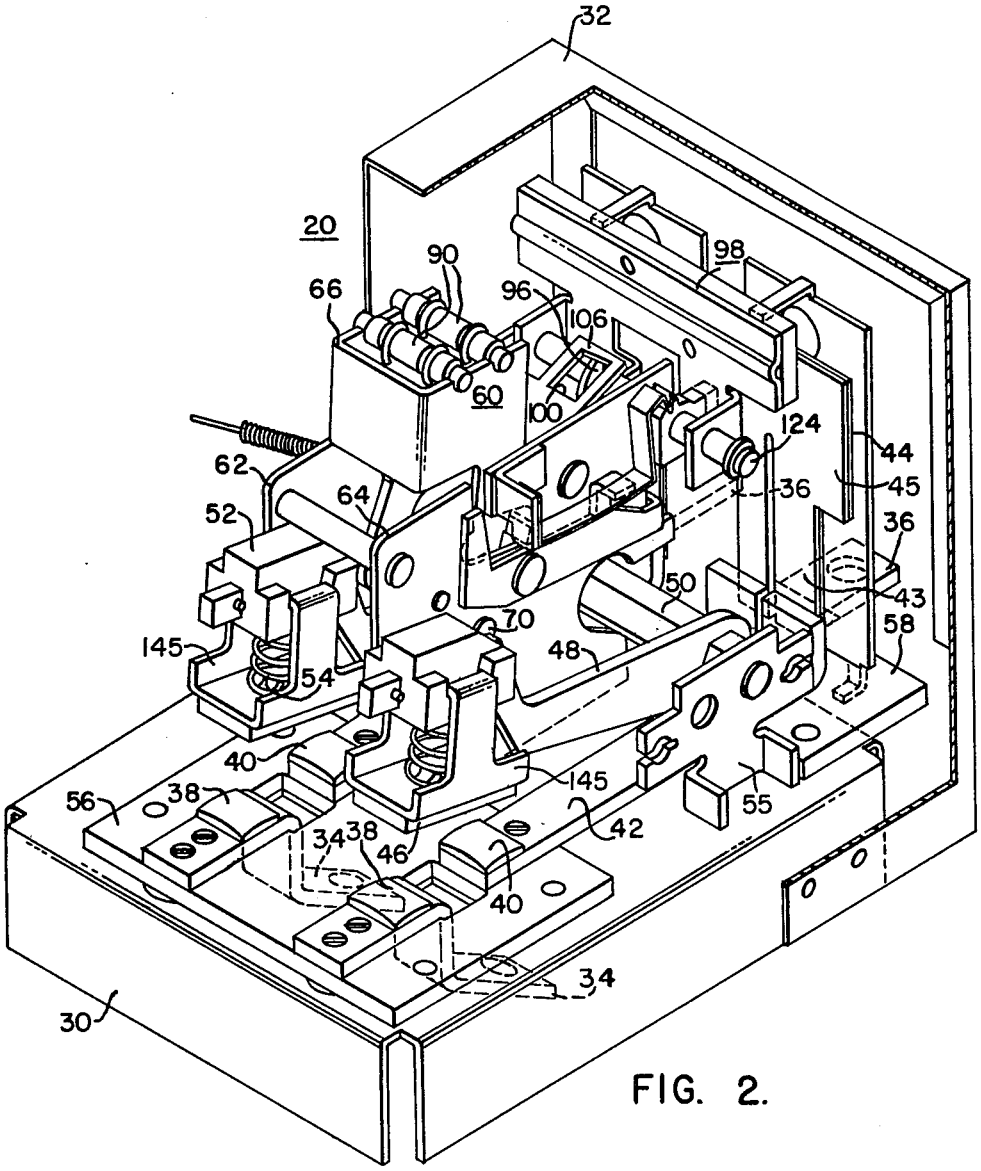
FIG. 2 is a perspective view of a secondary circuit interrupter for use on a distribution transformer utilizing the teachings of the present invention.
Figure 3:
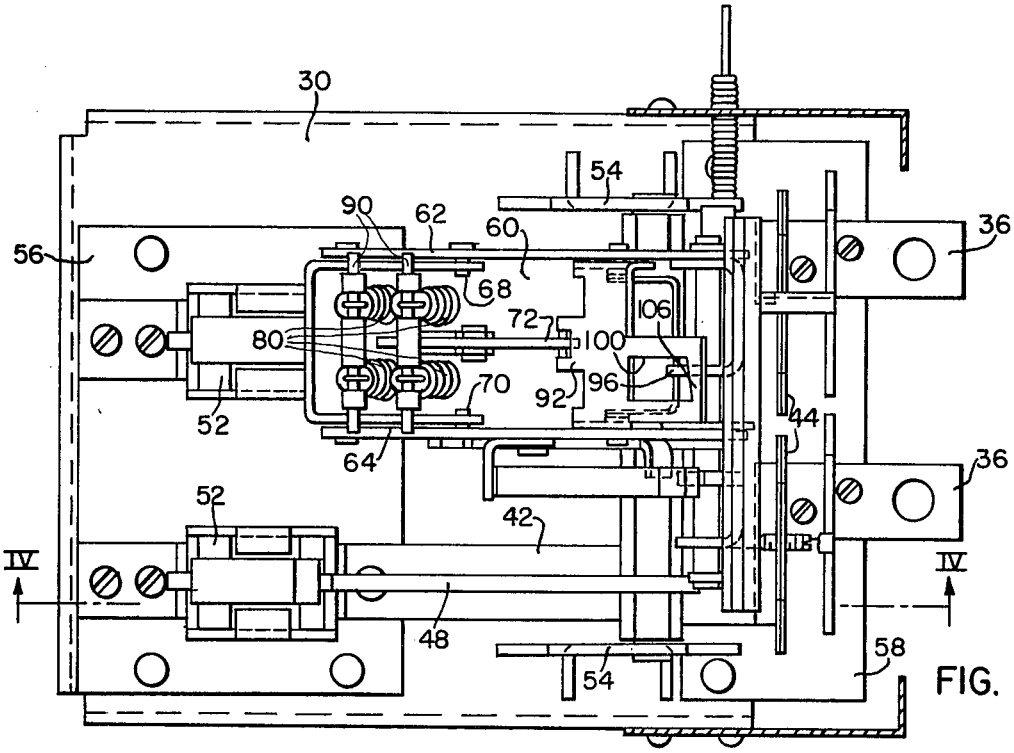
FIG. 3 is a top view of the circuit interrupter shown in FIG. 2 with the contacts in the closed position.
Figure 4:
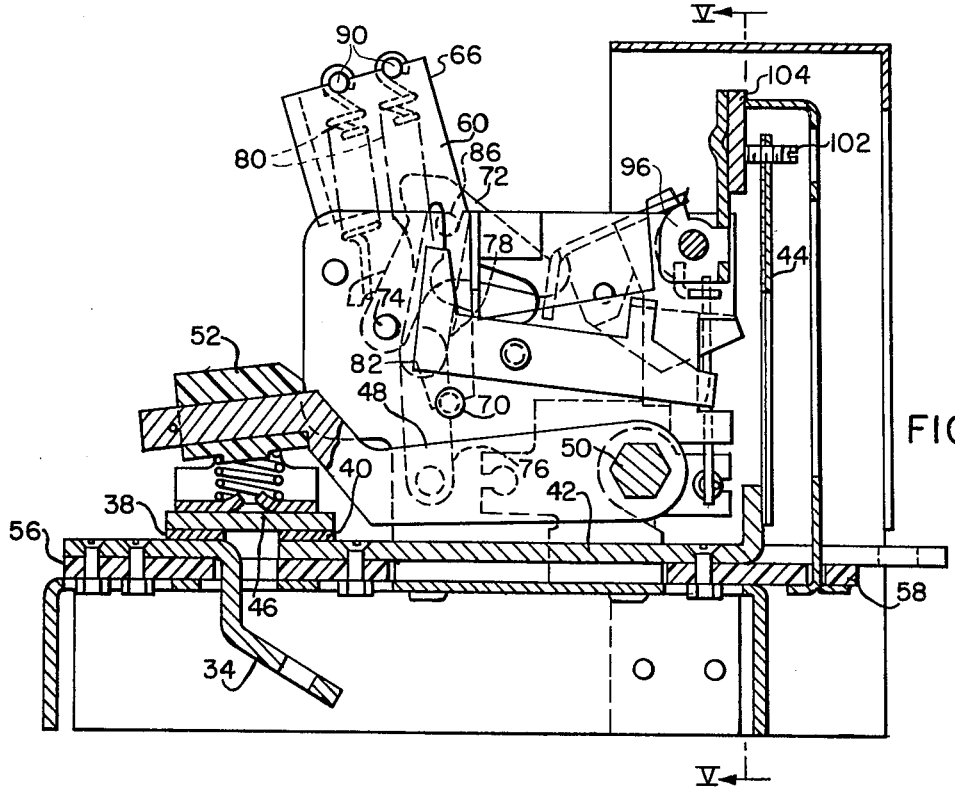
FIG. 4 is a sectional view of the circuit interrupter shown in FIG. 3 along the lines IV—IV.

Referring now to FIGS. 2 through 4, there are shown embodiments of circuit breaker 20 utilizing the teaching of the present invention. FIG. 2 shows an isometric view of a two-pole circuit breaker utilizing the teaching of the present invention. The circuit interrupter 20 is mounted on a metallic base 30. A cover 32 is provided partially surrounding the sensing and tripping elements of the circuit breaker 20 to provide protection during handling. Secondary leads 22 of the core and coil assembly 18 are attached to incoming circuit breaker terminals 34. Electrical conductors 24, disposed between the circuit breaker 20 and the low voltage transformer bushings 15, attach to circuit breaker 20 at terminals 36. Circuit breaker terminals 34 connect to stationary contacts 38. Circuit breaker terminals 36 connect to stationary contacts 40 through electrical conductor 42 and bimetal 44. Stationary contacts 38 and 40 of each pole are disposed in a spaced apart relationship. A bridging contact 46 is provided which, with the circuit breaker in the closed position, completes an electrical connection between stationary contacts 38 and 40. Thus, with the current interrupter 20 closed, an electric circuit is completed from a terminal 34 through stationary contact 38, through bridging contact 46, through stationary contact 40, through electrical conductor 42, through bimetal 44, to circuit breaker terminal 36. The bridging contact assembly 45 includes the movable bridging contact 46 attached to one portion thereof which, when the circuit interrupter is closed, completes an electrical connection between stationary contacts 38 and 40.

In the disclosed distribution transformer, the bridging contact is located below the bimetal 44. This is a most desirable feature since, if for any reason a transformer should develop an oil leak, the bimetal will be first to be exposed above the oil in the gas space and will heat up rapidly causing the breaker to trip while the contacts 46, 38 and 40 are still under the oil. This sequence of operation is desirable since it prevents contact arcing in the volatile gas space above the reduced oil level.

Each pole of the circuit breaker 20 is provided with an elongated contact arm 48 which at one end is rigidly secured to a through shaft 50. Shaft 50, which can be a metallic member, connects together the elongated contact arms 48 of all poles of the circuit interrupter 20 for simultaneous movement. That is, the contact arms 48 are connected together through shaft 50 so they move in unison. The bridging assembly 45 is connected to the end of the elongated contact arm 48 opposite shaft 50. An insulating member 52 is provided at the end of contact arm 48 so that contact arm 48 is electrically insulated from the bridging contact assembly 45. A spring 54 is provided in contact assembly 45 to provide uniform contact pressure and proper seating of the bridging contact 46 on the stationary contacts 38 and 40. As can be seen from the drawings, when any one of the poles of the circuit interrupter 20 open, all the other poles must also open.

Through shaft 50 is rotatably supported by brackets 55 which are attached to the metallic base 30. Stationary contacts 38 and 40 are electrically insulated from base plate 30 by insulating sheet 56 which is secured to base plate 30. Terminal 36 is connected to insulating sheet 58 which is rigidly secured to base plate 30. Electrical conductor 42 is insulated from base plate 30 by insulating sheets 56 and 58 and transformer oil 19 which fills the open spaces in the circuit interrupter 20 during normal operation. Conductor 42 which is generally L-shaped has its short leg portion attached to one leg of bimetal 44. The other leg of bimetal 44 attaches to L-shaped terminal 36.

A single operating mechanism 60 is provided for operating all poles of the circuit interrupter 20. Operator 60 is connected to one of the elongated contact arms 48 and as this contact arm 48 is moved in response to the positioning of the operator 60, the other elongated contact arm 48 connected through shaft 50, also responds. The single operating mechanism 60 for all poles is mounted on side plates 62 and 64 which are securely attached to support base 30. The operating mechanism comprises a U-shaped operating member 66, the two legs of which are pivotally connected to side plates 62 and 64 at points 68 and 70, respectively. A primary latch 72 is provided and is pivotally connected to a shaft 74 disposed between side plates 62 and 64. A pair of toggle links 76 and 78 are provided with one end of the toggle connected to the elongated contact arm 48 and the other end of the toggle connected to primary latch 72 and having multiple springs 80 connected between the knee of the toggle 82 and the top of U-shaped member 66 for raising contact arm 48 with a snap action when primary latch 72 is released. Toggle links 76 and 78 are pivotally connected together by knee pivot pin 82. The lower toggle member 76 is connected at its lower end by a pivot pin to an elongated contact arm 48. The upper ends of the pair of toggle links 78 have a U-shaped slot formed therein which fits around a shaft 86 connected to primary latch 72. That is, primary latch 72 is disposed between the pair of toggles 78 so that the supported shaft fits into the U-shaped slot formed in the upper toggle links 78. Spring holders are attached to knee pin 82 and engage the lower ends of the plurality of springs 80. Shafts 90 fit on top of U-shaped member 66 and are engaged by the upper end of springs 80. The upward force exerted by springs 80 holds toggle links 78 in engagement with the shaft 86 on primary latch 72. When the circuit breaker is assembled, the ends of the pair of links 78 are crimped to assure that they remain in engagement with pin 86. Releasable primary latch 72 is held in a latched position by secondary latch 92. Secondary latch 92 is biased toward an unlatched position by a torsion spring. When secondary latch 92 moves to the unlatched position, primary latch 72 is released and rotates around shaft 74 due to the force of springs 80 collapsing the toggle 76-78 and raising the elongated contact arm 48.

Secondary latch 92 is prevented from moving to the unlatched position when the breaker is closed by a cam surface 96 which is part of a trip bar mechanism 98. As can be seen in FIGS. 3 and 4, with the circuit breaker normally closed a portion 106 of secondary latch 92 rests against the cam surface 96. When the trip bar mechanism is rotated a predetermined angle counterclockwise, the cam surface 96 passes through opening 100 in secondary latch 92, permitting secondary latch 92 to rotate to the unlatched position, releasing primary latch 72 and tripping open the circuit breaker 20. Trip bar mechanism 98 is connected to be rotated by current responsive means when the current through the circuit breaker 20 exceeds a predetermined value.

Each pole of the circuit breaker 20 is provided with an individual trip device including a current responsive bimetal element 44, through which the load current of the associated pole passes. That is, the bimetal element 44 is electrically connected in the circuit of the circuit breaker 20 in series relation with the breaker contacts 38, 40 and 46. The bimetal 44 is generally U-shaped with an adjusting screw 102 threadedly mounted in the bight portion. One leg of the bimetal 44 is connected to fixed conductor 42 and the other leg of bimetal 44 is connected to fixed terminal 36. Adjusting screw 102 is disposed so as to contact an insulating portion 104 of trip bar mechanism 98 when bimetal 44 deflects. Upon occurrence of, for example, an overload of less than 500% of normal rated current, the bimetal element is heated and deflects toward the trip bar mechanism 98. As the bimetal element deflects due to the flow of current therethrough, the rounded edge of adjusted screw 102 engages the insulating sheet 104 attached to trip bar mechanism 98, rotating the trip bar 98 counterclockwise to a tripped position releasing secondary latch 92 and tripping open the circuit interrupter 20. The cam portion 96 of trip bar mechanism 98 moved from under the latching surface 106 to release the secondary latch 92. Primary latch 72 then rotates around pivot 74, moving the line of action of the springs 80 to the left of toggle pivot knee 82 causing the toggle 76-78 to collapse and opens the circuit interrupter 20 with a snap action.

Figure 6:
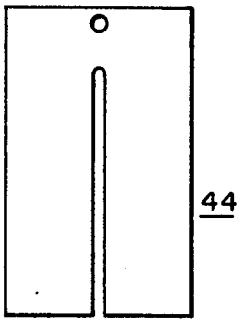
FIG. 6. PRIOR ART
FIG. 6 is a view of a prior art bimetal.
Figure 7:
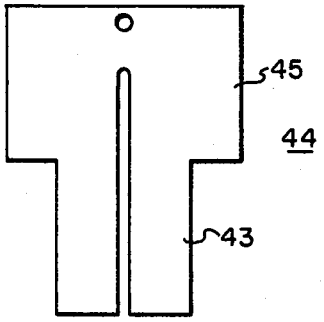
FIG. 7 is a view of a bimetal constructed in accordance with the teachings of the present invention.

The construction of bimetallic thermal element 44 for use in an oil immersed circuit interrupter 20 requires that two conditions be fulfilled: (1) a given oil temperature change ($\Delta T$) must produce the required deflection; and (2) a given current flow for a selected period of time must also produce the required deflection. Prior art bimetal thermal trip elements are generally constructed with a linear power distribution along their length, as shown in FIG. 6. A bimetal constructed in accordance with the teaching of the present invention, as shown in FIG. 7, can provide the desired deflection with a reduced power dissipation. A bimetal 44 constructed in accordance with the teaching of the present invention has a narrow portion 43 formed towards the supported end thereof and a relatively wider portion 45 formed towards the deflecting end thereof. In order to better understand the invention refer to FIG. 5, which shows a deflected bimetal. Assuming a 2" bimetal with a given thickness, the required deflection can be obtained from the following formula:

$$B = (.53F\,\Delta TL^2)/t$$

wherein $F$ is a constant, $T\Delta$ *is the temperature change,*

$L$ is the length of the bimetal, and $t$ is the bimetal thickness.

Figure 5:
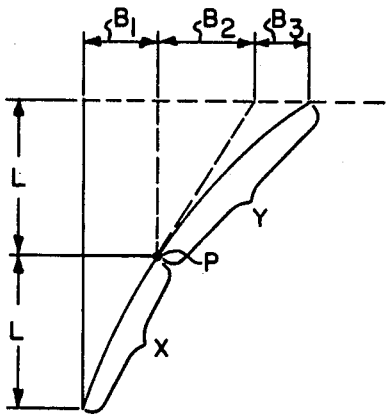
FIG. 5 is a side view of a bimetal used to explain the teachings of the present invention.

For example assume:

$$\Delta T = 100°\ \mathrm{F}$$

$$.53F/t = 1 \times 10^{-4}$$

therefore $$B \text{ at tip} = .53F/t\ \Delta T\,L^2 = 1 \times 10^{-4} \times 100 \times 2^2 = .040 \text{ in.}$$

as shown in the FIG. 5.

Now to analyze what occurs when current flows through the bimetal assume the required current flow dissipates 1 watt in each of the two 1-inch sections X and Y. In this case, of course, the temperature of the bimetal must increase 100° F.

For the purpose of the analysis we can assume the bimetal is divided into two sections X and Y. The total deflection can be viewed as the sum of several contributions. The lower section X will deflect:

$$B = (.53F\,\Delta T/t)\,L^2 = (.53F/t)\,(100)\,(1)^2 = 10^{-4} \times 100 \times 1 = 0.010 \text{ inch}$$

The upper section will deflect the same as the lower section but in addition, since it is effectively attached to the tangent of the tip of the lower section, it will deflect the amount a straight rigid extension would deflect. Thus the upper section will deflect 0.010 inch plus the slope times the distance. The slope is calculated by:

$$\frac{d}{dL} B = \frac{d}{dL} \frac{.53F}{t} \Delta T L^2$$

$$\frac{dB}{dL} = (\frac{.53F}{t}) (\Delta T) \times 2 \times L = (10^{-4}) (100) \times 2 \times L = .01 \times 2 \times L = .01 \times 2 \times 1$$

$$\frac{dB}{dL} = .02''$$

Since $L = 1$ then the deflection due to the slope = 0.02 inch.

By using the same bimetal thickness (which will give the same deflection for a $\Delta T$ oil temperature change) but instead of having a uniform distribution of heat along the bimetal, the heat is concentrated in the lower part of the bimetal, an advantage is gained in the overall deflection. If 1.5 watts is dissipated in X and 0.5 watts is dissipated in Y, the same total watts, 2, are dissipated but deflection is increased.

The deflection of the lower section will increase in direct proportion to its temperature which in turn is proportional to the watts dissipated (assuming a short time). Thus the deflection due to the lower section temperature is:

$$B = (\frac{.53F}{t}) (\Delta T) L^2$$

$$= (1 \times 10^{-4}) (1.5 \times 100) 1^2$$

$$= .015''$$

The deflection due to the tangent is:

$$\frac{dB}{dL} = (\frac{.53F}{t}) (\Delta T) \times 2 \times L = (10^{-4}) (1.5 \times 100) \times 2 \times L$$

$$\frac{dB}{dL} = .03$$

$$B = .03 \times L = .03 \times 1 = .03''$$

The deflection due to the upper section is:

$$B = (\frac{.53F}{t}) (\Delta T) L^2 = 10^{-4} (\frac{1}{2} \times 100) 1^2$$

$$B = .005$$

Thus the total deflection is:

$$0.015 + 0.030 + 0.005 = 0.050 \text{ inch}$$

This, of course, is greater than the 0.040 inch deflection produced with the uniform dissipation distribution.

As a direct indication of the power saving, the calculation of the power required for 0.040 inch deflection using the above configuration namely, 3 times the power in the lower section than in the upper section, shows 1.2 watts in lower section and 0.4 watts in the upper section for a total of 1.6 watts. For this particular case there is a savings of 0.4 watts out of 2 watts which is a 20% reduction.

The calculation for the 0.040 inch deflection is:

slope at midpoint, $P = .02\ X$ $$B_2 = .02X$$

-continued $$B_1 = (10^{-4}) (\frac{X}{1} \times 100) = .01X$$

$$B_3 = \frac{1}{3} B_1 = \frac{1}{3} (.01X)$$

$$B_1 + B_2 + B_3 = .040$$

$$.01 + .02X + \frac{1}{3} (.01X) = .040$$

$$3\frac{1}{3X} = 4$$

$$X = \frac{4}{3\frac{1}{3}} = 1.2 \text{ watts}$$

$$Y = \frac{1}{3X} = .4 \text{ watts}$$

In order to accommodate the above, the thickness, of course, will remain the same while the width will have to change to reduce the power dissipation.

Since the power dissipated varies with the width as:

Power (in watts) = R/(width)$^2$ then the ratio of widths for the 0.4 watt upper section versus the 1 watt upper section is:

$$\frac{(W_{0.4})^2}{(W_{1.0})^2} = \frac{1.0 \text{ watt}}{0.4 \text{ watt}}$$

$$W_{0.4} = W_{1.0} \frac{1.0}{0.4} = 1.58\ W_{1.0}$$

Similarly the ratio of widths for the 1.2 watt lower section versus the 1.0 watt lower section is:

$$\frac{(W_{1.2})^2}{(W_{1.0})^2} = \frac{1.0 \text{ watt}}{1.2 \text{ watt}}$$

$$W_{1.2} = W_{1.0} \frac{1.0}{1.2} = W_{1.0} \times .91$$

The prior art bimetal configuration versus the new configuration is shown in FIGS. 6 and 7.

Many variations of the above can, of course, be developed to fit particular situations, however, they will all have the common feature of concentrating the power dissipated in the relatively lower fixed section of the bimetal.

What is claimed is:

1. A circuit interrupter comprising:

a first stationary contact;

a second stationary contact separated from said first stationary contact;

bridging contact means;

an elongated contact arm having said bridging contact means attached thereto and being pivotal about an axis between a closed position wherein said bridging contact means completes an electric circuit between said first stationary contact and said second stationary contact and an open position wherein said bridging contact means is spaced apart from said first stationary contact and said second stationary contact;

primary latch means connected to said elongated contact arm and, when in a latching position, latching said elongated contact arm in the closed position;

a secondary latch when in a latching position keeping said primary latch means in the latching position; and, planar bimetal actuating means comprising an elongated planar bimetal held relatively stationary at one end and being responsive to current flow therethrough and ambient oil temperature to deflect at the other end and unlatch said secondary latch when current flow through the circuit interrupter exceeds a trip level, said elongated planar bimetal being constructed to have a higher power dissipation in proximity to the relatively stationary end than in proximity to the deflecting end.

2. A circuit interrupter as claimed in claim 1 wherein said planar bimetal actuating means comprises a planar elongated bimetal having a constant thickness, said bimetal element comprising two legs and a bight portion, one end of each of said legs being connected by said bight portion and being free to deflect, the other ends of each of said legs being relatively stationary, the width of said legs in proximity to the connected ends being greater than the width of said legs in proximity to the unconnected ends.

3. A transformer having a housing with a circuit interrupter switchable between an open position wherein the electrical connections through the transformer are open and a closed position wherein the electrical connections through the transformer are closed, said circuit interrupter being disposed within the housing and comprising:

a pair of stationary contacts;

bridging contact means movable between an open position spaced from said pair of stationary contacts and a closed position engaging said pair of stationary contacts and completing a series circuit therethrough;

spring biasing means biasing said bridging contact means away from said pair of stationary contacts;

latch means movable between a latched position holding said bridging contact means in engagement with said pair of stationary contacts and an unlatched position allowing said bridging contact means to move away from said stationary contact means in response to said spring biasing means;

planar bimetal actuating means connected in said circuit interrupter so that transformer current flows therethrough, said planar bimetal actuating means being cooperatively associated with said latch means to move said latch means to an unlatched position when current flow exceeds a trip level;

said planar bimetal actuating means comprising a stationary end being relatively fixed with respect to the transformer housing and a movable end being relatively movable with respect to the transformer housing, said planar bimetal actuating means being constructed to have a higher electrical resistance in proximity to the stationary bimetal end than at the movable bimetal end.

4. An oil-filled distribution transformer having a secondary circuit interrupter disposed in the transformer housing below the oil level, wherein the secondary circuit interrupter comprises:

a stationary contact;

a movable contact movable between an open position spaced from said stationary contact and a closed position engaging said stationary contact and completing an electrical circuit through the transformer;

biasing means urging said movable contact to the open position;

latching means having a latched position holding said movable contacts in the closed position and an unlatched position permitting said bridging contact to move to the open position;

a planar bimetal trip associated with said latching means to move said latching means to an unlatched position when current flow through the transformer exceeds a predetermined trip level; and, said planar bimetal trip having a stationary end and a movable end and being constructed to dissipate more energy in the stationary end of the bimetal trip than in the movable end of the bimetal with current flow therethrough.

5. A circuit interrupter comprising:

separable contacts;

a latch mechanism releasable to effect automatic separation of said contacts; and bimetal actuating means comprising a planar bimetal element connected in series circuit relationship with said contacts, said planar bimetal element having a stationary end and a movable end, and being responsive to current flow through said contacts to deflect said movable end upon overcurrent condition and cause said latch mechanism to release, said planar bimetal element being constructed so as to dissipate more energy at its stationary end that at its movable end, whereby deflection of said movable end is increased for a given amount of power dissipation throughout said bimetal element.

6. A circuit interrupter as recited in claim 5 wherein said planar bimetal element comprises two legs and a bight portion connecting one end of each of said legs, the other end of said legs being stationary and the bight portion being movable relative to said stationary ends.

* * * * *